US005528834A

United States Patent [19]

Seber et al.

[11] Patent Number: 5,528,834

[45] Date of Patent: Jun. 25, 1996

[54] FIXED-BLADE KNIFE FOR RUGGED SERVICE AND ITS MANUFACTURE

[75] Inventors: Brett P. Seber, Escondido; Roy L. Helton, Jr., San Diego; Randolph J. Morton, Coronado; John Craddock, Alta Loma; Kirby Johnson, Murrieta, all of Calif.

[73] Assignee: Buck Knives, Inc., El Cajon, Calif.

[21] Appl. No.: 180,915

[22] Filed: Jan. 12, 1994

[51] Int. Cl.[6] ..... B26B 3/00; B25G 1/10

[52] U.S. Cl. ..... 30/340; 30/343; D22/118

[58] Field of Search ..... 30/295, 340, 343; 16/110 R, 116 R, DIG. 19; D22/118

[56] References Cited

U.S. PATENT DOCUMENTS

D. 220,930 6/1971 Arlette ..... D22/118

4,712,304 12/1987 Sanelli ..... 16/DIG. 19

5,210,925 5/1993 Morgulis ..... 30/340

FOREIGN PATENT DOCUMENTS 2800796 7/1979 WIPO ..... 30/340

*Primary Examiner*—Douglas D. Watts

*Attorney, Agent, or Firm*—Gregory Garmong

[57] ABSTRACT

A knife has a fixed blade, a plastic base fixed to the tang of the blade, and a rugged rubber grip fixed to the plastic base. A visible portion of the plastic base extends along a back of the knife and also forms a hilt and forwardly swept guard. A visible portion of the rubber forms a grip along the bottom and sides of the handle, and also a thumb rest along the top of the handle at the guard. The handle is formed by injection molding the plastic to the tang of the blade, and thereafter injection molding the rubber to the plastic. The plastic base has features thereon for ensuring that the rubber is strongly fixed to the plastic. The base and the grip are made of strong, tough, damage-resistant materials.

10 Claims, 3 Drawing Sheets

FIXED-BLADE KNIFE FOR RUGGED SERVICE AND ITS MANUFACTURE

BACKGROUND OF THE INVENTION

This invention relates to a fixed-blade knife structured and constructed for rugged service, and, more particularly, to such a knife having a steel blade and tang, and an injection co-molded plastic and rubber handle.

Knives may be generally classified as fixed-blade and movable-blade designs. The common hunting knife and folding pocket knife are examples of these two types. Fixed-blade knives are typically stronger and capable of heavier-duty service than movable-blade knives. The movable-blade knives have the advantages that a variety of blades (or tools) can be provided in a single knife, and the blade(s) can be folded away for storage. The present invention relates to fixed-blade knives.

For some applications, fixed-blade knives must be capable of bearing large loadings and withstanding extreme abuse without failing. As an example, some users may require a knife that can be used in the traditional cutting role of a knife and weapon. The knife must be designed so that it is easily and firmly grasped when used in these ways. Beyond these conventional roles, the knife must also serve as a pry bar, a wedge, a hammer, or other type of tool, because the user may only carry the knife when entering hostile conditions where these other tool capabilities may be required. The user must be able to grip the knife whether the handle is wet or dry, and must be able to properly orient the knife solely by feel so that it can be used in darkness. The knife must not fail in any of these uses, or when subjected to other extreme conditions such as being run over by a vehicle, hit by a bullet, abraded, placed in a flame, or contacted to corrosive or other damaging fluids.

Most commonly, a fixed-blade knife has a blade with a tang extending from the blade. Side pieces are attached over the sides of the blade with fasteners such as rivets. Experience shows that these conventional fixed-blade knives cannot begin to perform the functions described above for a rugged-service knife, as the fasteners soon loosen or fail and the side pieces fall away, or the blade/tang fails.

More recently, it has been possible to injection mold one-piece plastic or rubber handles onto the tangs of fixed-blade knives. While an improvement over fixed-blade knives with fastened side pieces, these knives still have shortcomings when used in extreme conditions. For example, plastic is difficult to grasp, while rubber lacks the required strength and rigidity.

There continues to be a need for a fixed-blade knife that is suitable for use in the most rugged, extreme conditions, and will not fail in such use. The present invention fulfills this need, and further provides related advantages.

SUMMARY OF THE INVENTION

The present invention provides a fixed-blade knife, and a method for its manufacture. The knife of the invention can be used for traditional knife cutting and weapons functions, and also for tool-like functions such as a pry bar or a hammer. An excellent grip can be maintained on the handle even when the handle is wet, and the knife can be oriented quickly solely by feel. The user of the knife can apply a force through the knife to the limit of the user's strength, as the handle is structured for a comfortable transfer of large amounts of force through a grasping hand. There is no folding or other mechanism that would weaken the knife structure.

In accordance with the invention, a knife comprises a blade that is elongated in an elongation direction, a tang extending from the blade generally parallel to the elongation direction, and a handle attached to the tang of the blade. The handle comprises a plastic base fixed to the tang and having an externally visible exposed plastic portion, and a rubber grip fixed to the plastic base and having an externally visible exposed rubber portion.

Desirably, the exposed plastic portion of the plastic base extends generally parallel to the elongation direction along a top of the knife and at the butt, providing a rigid holding structure that also can be used as a hammering tool. The exposed rubber portion is fixed to the portion of the plastic base that is not visible in a manner such that it cannot be separated from the plastic. The exposed rubber portion extends along the bottom and sides of the knife, providing a secure gripping region. Protruding raised regions along the bottom of the exposed rubber portion further assist in maintaining a secure grip.

In one form of the knife, the exposed plastic portion also forms a hilt that visibly separates the blade from the handle. The part of the hilt at the top of the knife is swept forwardly to form a guard. A region of exposed rubber is provided along the top surface of the forwardly swept guard to form a thumb rest. The thumb rest aids the user in orienting the knife even in darkness, and also allows the user to exert great force and leverage through the handle of the knife.

The blade, tang, plastic portion, and rubber portions of the knife are made from materials that can withstand punishment and difficult service conditions.

The knife of the invention is preferably made by an injection co-molding process wherein the plastic is first injection molded to the tang of the knife and then the rubber is injection molded to the plastic. The handle structure is selected to ensure secure fixing of the plastic to the tang, and secure fixing of the rubber to the plastic. In the preferred design, there is at least one, and preferably several, holes through the tang. The holes may serve in some instances to locate the tang in the injection molding machine, and in other instances are intentionally permitted to be penetrated by the plastic and rubber to form a rigid attachment between the plastic base on both sides of the handle and the rubber on both sides of the handle.

Although the exposed plastic portion is contoured and made generally smooth for ease in grasping along the top of the knife, the unexposed plastic portions are made with intentionally irregular features to ensure that the rubber will be firmly fixed to the plastic with mechanical locks. To this end, side channels are provided in the unexposed plastic portion to ensure locking of the rubber to the plastic, and also to prevent the rubber from deforming too extensively when the knife is twisted. On the other hand, the unexposed plastic portion along the bottom of the knife is made smooth, to permit the slight yielding and movement of the rubber that has been found beneficial in twisting applications. Undercuts are provided at the ends of the plastic base to prevent the rubber from being peeled away from the plastic at the ends. A channel structure intermediate the exposed plastic portion and the exposed rubber portion prevents the rubber from being peeled away from the plastic along the sides of the rubber grip.

The knife of the invention provides an important advance in the art of fixed-blade knives. The knife is suitable for a wide range of uses, both in traditional knife roles and nontraditional tool roles. The blade/tang unit is made with a strong, tough steel. It is secured to the plastic portion of the handle, which imparts strength and rigidity to the handle along the backbone of the knife. The rubber is secured to the plastic, and provides the knife handle with good grasping characteristics and also excellent vibration damping. The externally exposed combination of plastic and rubber provides a more serviceable handle than conventional handles wherein a core of plastic is completely laterally surrounded by a casing of rubber. Within a broad range of extreme conditions, the knife itself cannot be damaged and is virtually indestructible. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 3:
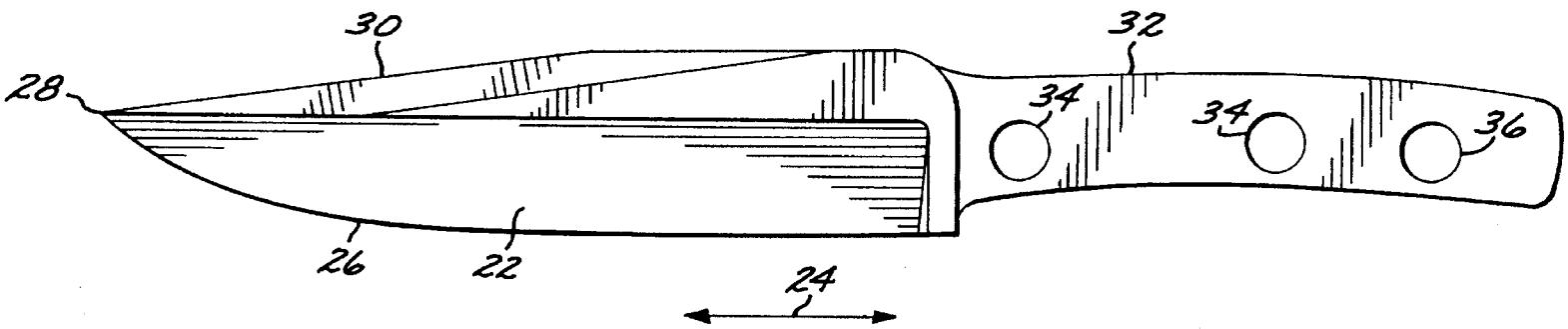
FIG. 3 is a side elevational view of the blade and tang of the knife at a first intermediate stage of manufacturing, without the plastic and rubber applied.
Figure 4:
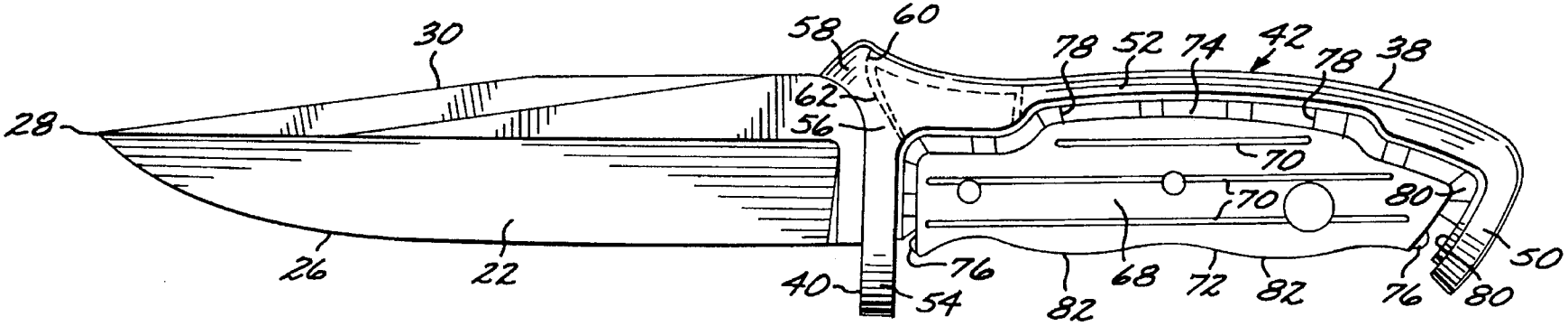
FIG. 4 is a side elevational view of the blade and tang with the plastic applied, at a second intermediate stage of fabrication without the rubber applied.
Figure 5:
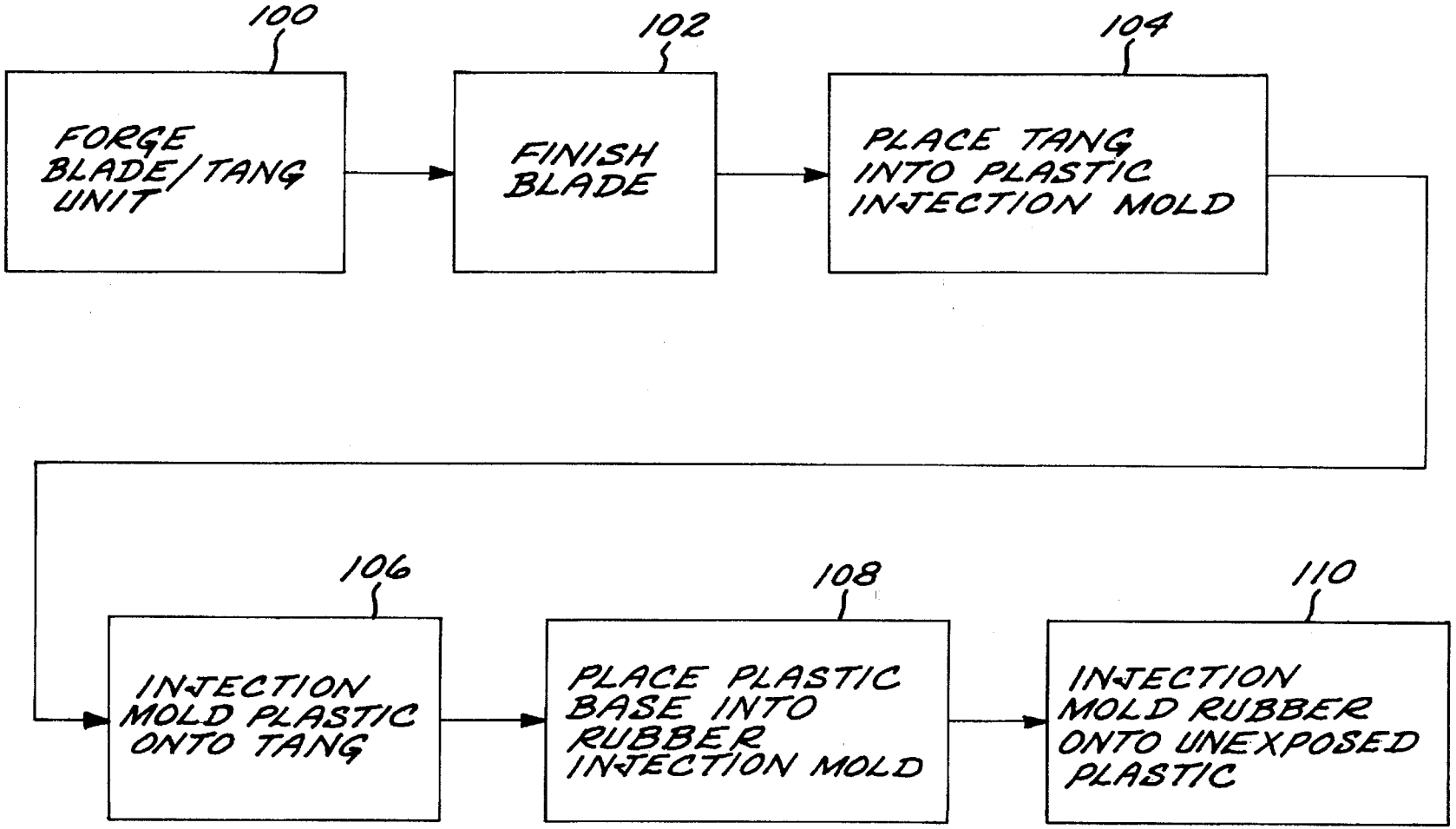
FIG. 5 is a process block flow diagram for the method of manufacturing the knife of the invention.

FIGS. 1–4 illustrate a fixed-blade knife 20 in its final form (FIGS. 1–2) and at intermediate stages of fabrication (FIGS. 9–4). During fabrication, the knife 20 progresses through the stages depicted in FIGS. 3, 4, and 1, in that order. FIG. 5 is a process flow diagram for the fabrication of the knife. The final structure of the knife 20 is best understood and described by following through the manufacturing process.

Figure 1:
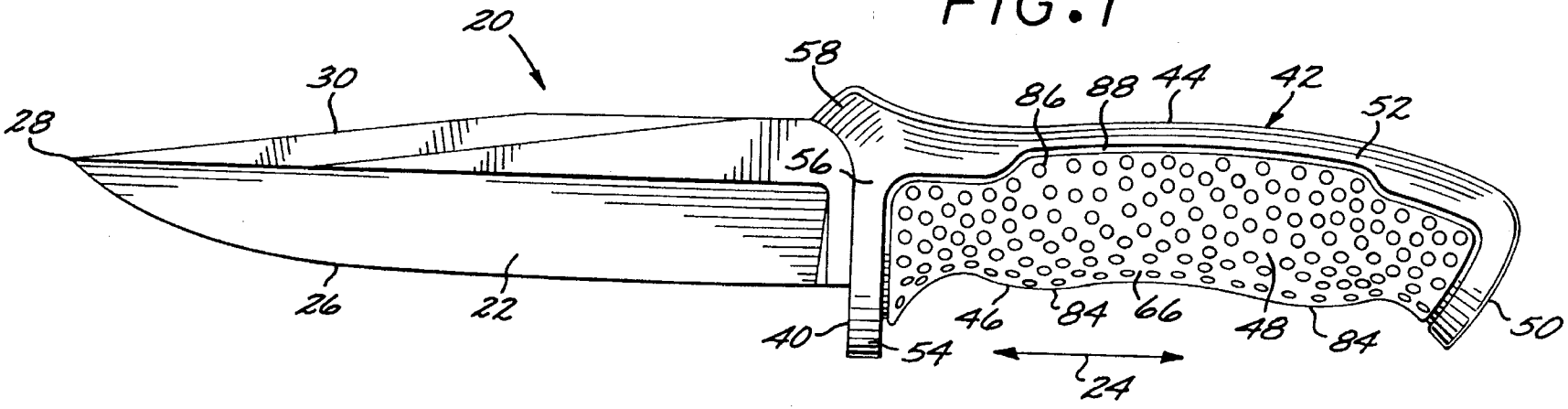
FIG. 1 is a side elevational view of the fixed-blade knife of the invention.
Figure 2:
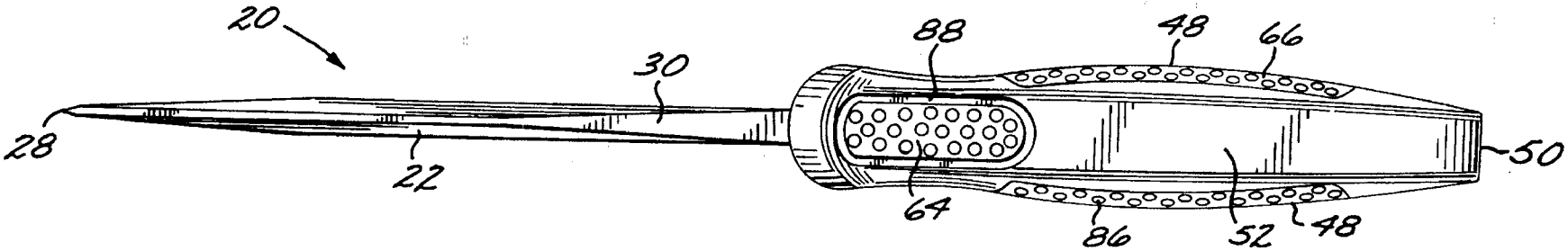
FIG. 2 is a top view of the knife of the invention.

The knife 20 has a blade 22 that is elongated in an elongation direction 24. The blade 22 has a cutting edge 26, a point 28, and a blade back 30. In a preferred embodiment, the blade 22 is about 6¼ inches long and about 0.220–0.250 inches thick. This blade thickness is greater than typical for a blade of this length, giving the blade great strength. FIG. 1 depicts the blade as being generally conventional in configuration, but other types of known features such as a knife-back saw, a knife-back rope cutter, a knife-back gut hook, or a knife-back wire cutter could be provided. The shape of the blade 20 can also be varied.

The blade is preferably made of stainless steel such as 154 CM stainless steel having a nominal composition in weight percent of 1.05 percent carbon, 0.5 percent manganese, 0.03 percent maximum phosphorus, 0.03 maximum percent sulfur, 0.3 percent silicon, 14.0 percent chromium, 4.0 percent molybdenum, balance iron and incidental impurities. This material gives the blade/tang unit good strength and toughness, and also good edge-holding characteristics. Other stainless steels and other suitable materials generally can be used to form the blade.

The blade can be provided with any type of surface finish that may be desired. In one preferred surface finish, the blade is given an adherent black oxide coating, according to MIL-STD-171 and MILC-16173, by placing the blade into a salt bath in the presence of water at a temperature of about 300° F., and then placing the blade into hot oil. In another preferred surface finish, an adherent titanium nitride coating is produced by vaporizing titanium in a nitrogen atmosphere with a plasma arc to deposit titanium nitride onto the blade. The resulting blade with a gold-colored deposit is placed into a heated methane atmosphere to blacken the deposit.

As shown in FIG. 3, a tang 32 is fixed to the blade 22 and extends from the blade 22 generally parallel to the elongation direction 24. The tang 32 is typically not perfectly straight, but is slightly curved. The tang 32 is a flat metal piece that is about the same thickness as the blade 22. The tang 32 is preferably integral with the blade 22 for strength, and therefore has the same chemical composition as the blade 22. The blade/tang unit is preferably prepared by fine blanking, but could be prepared by forging or other techniques.

There are holes 34 and 36 formed through the thickness of the tang 32 during its fabrication. The holes are of two types, the plastic-interconnect holes 34 that permit interconnection of later-provided plastic and rubber between the two sides of the knife handle, and the locating hole 36 that is received on a pin in an injection mold and serves to precisely locate the tang within the injection mold during the two injection molding operations and also provides good interconnection between the rubber regions on the two sides of the knife handle.

During fabrication, the tang 32 is held within the injection mold. Molten plastic is forced into the interior of the mold to fill the space between the tang 32 and the interior wall of the mold. Upon cooling and solidification, the plastic forms a plastic base 38. The extent and shape of the plastic base 38 can be best seen by comparing FIG. 3, the structure prior to injection molding of the plastic, and FIG. 4, the structure after injection molding of the plastic. As mentioned, a locating pin from the injection mold fits through the locating hole 36 and little if any plastic remains in the hole 36 after injection molding the plastic. A smaller-diameter sizing pin from the injection mold fits through the plastic bond holes 34, so that plastic flows, between the sizing pin and the hole 34 in the tang 32. This plastic therefore extends between the plastic on either side of the tang and the handle to aid in holding the two regions of plastic together. Is is further apparent from comparing FIGS. 4 and 1 that a portion of the plastic base is visibly exposed to external view in the final knife (FIG. 1), while a portion of the plastic base is unexposed and not visible in the final knife (FIG. 4) because it is covered with rubber.

The plastic used in the injection molding is preferably a kevlar-filled (reinforced) nylon-66. This plastic has been found to provide a desirable combination of hand-to-plastic feel, strength, toughness, resistance to abrasion, resistance to fire, resistance to chemicals and acids, and processability. In the final plastic material, about 5–6 volume percent of kevlar is dispersed within Zytel nylon-66 plastic. (To prepare this mixture, DuPont Wearforce material formed of a mixture of about 30 percent by volume kevlar fibers and 70 percent by volume Zytel 101 is mixed with Zytel ST-801 nylon-66 material also available from DuPont, to yield the desired 5–6 volume percent kevlar in the final product.) This mixture is injection molded to form the plastic base 38. The plastic used to form the base is not limited to this particular plastic, and the term "plastic" is to be broadly construed as the term is known in the art to mean a hard, strong plastic material. For example, glass-filed nylon and other hard, strong plastics can also be used.

The plastic base 38 includes a visibly exposed hilt 40 that extends generally perpendicularly to the elongation direction 24 and serves to visually separate the blade 22 from a handle 42 of the knife 22. The handle 42 itself may be described as having a top 44 which is on the opposite side of the knife from the cutting edge 26, a bottom 46 that is on the same side as the cutting edge 26, two oppositely disposed sides 48, and a butt end 50.

Another visibly exposed plastic portion forms a handle back 52 that extends the length of the handle 42 from the hilt 40 to the butt 50. The butt 50 itself is also formed of visibly exposed plastic. Forming the hilt 40, handle back 52, and butt 50 of the hard, rigid plastic material gives a strong backbone structure to the handle. These externally exposed plastic features are made generally smooth so that they do not easily snag and so that the handle back 52 fits comfortably into the palm of the user's hand in its normal position of use.

The hilt 40 includes a first region 54 that lies perpendicular to the elongation direction 24, and a second region 56 that is swept forwardly toward the blade 22 and the point 28 of the knife 20. The handle back 52 is sloped upwardly at its forwardmost end adjacent to the second region 56. The second region 56 of the hilt 40 and the forward end of the handle back 52 thus combine to produce and upwardly, forwardly sloping guard 58. The upper surface of the guard 58 includes a recess 60, and there are internal openings called runners 62 extending through the interior of the plastic base 38 from the periphery of the recess to the interior of the unexposed portion of the plastic base The runners 62 permit molten rubber to flow into the recess 60 to form a rubber thumb rest 64 in the forward end of the handle back of the finished knife, FIG. 2. The rubber material remaining within the runners serves to anchor the rubber thumb rest to the larger body of rubber forming the knife grip, after fabrication.

The plastic features just discussed form the exposed portion of the plastic base. The unexposed portion of the plastic base performs the important function of anchoring and fixing a rubber grip 66 and the continuous rubber thumb rest 64 to the handle 42 of the knife. In some instances of the prior art, it might be sufficient to attach a rubber grip to a plastic base with adhesives or the like. Known adhesives are simply not sufficiently strong and durable to be operable as the sole means of fixing the grip to the plastic base in the rugged service required of the knife 20.

In the present approach, the unexposed portions of the plastic base 38 are provided with a number of mechanical means for fixing and retaining rubber in contact with the plastic base 38. Each side 68 of the unexposed plastic portion preferably has at least one, and more preferably several, grooves 70 extending generally parallel to the elongation direction 24. The grooves 70 tend to mechanically lock the subsequently injection-molded rubber onto the sides 68 of the plastic base 38. This locking is particular important to resist separation of the rubber and the plastic when the knife is twisted during use. It is preferred, however, that a bottom 72 of the unexposed portion have no grooves or other mechanical locking features, so that the rubber is free to move slightly over this surface. It has been found that such movement is beneficial in seating the knife comfortably in the user's hand when large force is exerted through the knife.

The edges of the rubber must also be carefully locked mechanically against the plastic, because detachment of the rubber from the plastic would otherwise likely commence at the edges of the rubber region. To this end, a channel 74 is provided intermediate the exposed portion of the plastic base 38 and the rubber grip 66 (which covers the unexposed portion of the plastic grip). The channel 74 is about 0.075 inches wide and extends about 0.1–0.2 inches below the side 68 of the unexposed portion of the plastic base. During injection molding of the rubber to form the rubber grip 66 and its contiguous thumb rest 64, rubber flows into the channel 74 and mechanically locks into the channel.

The mechanical locking of the rubber into the channel 74 is further aided by features molded into the interior of the channel. An undercut bump 76 is molded into the unexposed region within the channel, but near the ends of the channel. The injected rubber forms around this bump 76 so that the rubber cannot be peeled away from the unexposed region of the plastic base 38 at its ends.

Retaining ridges 78 are formed at the bottom of the channel 74 along its length. The retaining ridges also serve to mechanically lock the rubber grip 66 into the channel 74, and thence to the unexposed plastic portion of the plastic base 98.

Finally, although the tang 32 underlies a large portion of the unexposed plastic portion, the tang 32 does not extend the entire distance through the handle to the butt region 50. In the region where the side 68 does not overlie the tang 92, openings 80 extend entirely through the plastic base 38 within the channel 74. Rubber that forms the rubber grip 66 flows through these openings, linking the portions of the rubber grip 66 on the opposing sides of the knife. Such a link through the openings 80 is effective to retain the edges of the rubber grip 66 within the channel 74 and thence to the unexposed plastic portion. Similarly, the rubber penetrates through those portions of the holes 34 and 36 that are not filled with plastic, achieving side-to-side linking and anchoring of the rubber between the central side portions of the rubber grip 66.

These various structures serve to securely fasten the rubber grip to the plastic base, both centrally and at the edges of the rubber. It is therefore extremely difficult to separate the rubber from the plastic.

The bottom 72 of the plastic base 98 is smooth, but is formed with two outwardly protruding raised plastic regions 82 at different distances from the blade 22 along the elongation direction 84. When the rubber of the rubber grip 66 is overlaid onto the raised plastic regions 82, corresponding raised rubber regions 84 in the final knife handle define slight bulges in the knife handle which can be easily gripped by the user of the knife. This grip shape on the bottom 46 of the handle, coupled with the use of a slightly deformable rubber material, the locking of the grooves 70, and the smooth bottom surface of the plastic base, have been found to provide a particularly effective grip for the user of the knife when the knife is used as a weapon. The rubber is permitted to deform slightly to conform to the movement of the user's hand at and near the bottom 46 of the handle 42, but not along the sides 48 where the tight mechanical contact of the rubber to the plastic base is maintained. The rubber material also is highly effective to absorb forces, shocks, and vibrations that would otherwise be transmitted into the hand of the user.

The rubber grip 66 and its contiguous thumb rest 64 are formed by placing the partly finished knife into an injection molding machine with the plastic base 38 within a rubber molding die that defines the shape and surface morphology of the rubber grip 66. In the present case, the molding die is provided with slight depressions around the rubber grip area, so that there are slight protrusions 86 covering the rubber grip 66. Such protrusions are an aid to a firm, reliable grip of the user's hand on the rubber grip 66, particularly when the grip 66 is wet.

Mechanical shutoffs fit between the exposed portion of the plastic base that forms the hilt 40, the handle back 52, and the butt 50, on the one hand, and the region that is to be filled with the rubbery material. Molten rubber is forced under pressure into the remaining space between the unexposed portion of the plastic base 38 and the rubber injection mold. The rubber flows through the runners 62 to form the thumb rest 64 as well. Upon cooling, there is a separating recess 88 between the plastic of the exposed portion of the plastic base and the rubber of the rubber grip 66 and the thumb rest 64, which visually defines the separation between the plastic and the rubber.

A wide variety of rubbery, elastomeric materials are suitable for use in forming the rubber grip 66 and the thumb rest 64. For injection molding, the rubber material is a thermoplastic rubber that has an acceptable hardness and is resistant to damage in adverse environments such as heat, solvents, and acids. The thermoplastic rubber preferably has a durometer Shore A hardness of from about 50 to about 90, which has been found to provide a suitable compromise of firmness for normal use and compliancy when large forces are applied through the rubber grip 66 and the thumb rest 64 or when the blade is vibrated and the rubber must absorb the vibration. The most preferred rubber is a polyolefin elastomer. Such a rubber is available commercially from DuPont as Alcryn 2060 thermoplastic rubber having a Shore A durometer hardness of about 60.

FIG. 5 illustrates the fabrication of the knife in block diagram form. The blade/tang unit is provided, preferably by fine blanking, numeral 100. The holes 36 and 38 are also formed in the tang. The desired finish is applied to the blade, numeral 102. The blade/tang unit is placed into the injection molding machine with the tang extending into the mold that is used to form the plastic base 38, numeral 104. The molten thermoplastic plastic material is forced into the mold to form the plastic base 38, numeral 106. The plastic base 38 (attached to the tang) is then placed into the injection mold which forms the rubber grip 66 and thumb rest 64, numeral 108. The thermoplastic rubber is injection molded under heat and pressure into the mold cavity, numeral 110, and the knife is finished to the form shown in FIG. 1.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A knife, comprising:

a blade that is elongated in an elongation direction;

a tang extending from the blade generally parallel to the elongation direction;

a handle attached to the tang of the blade, wherein the handle has a top, a bottom, two sides, and a butt remote from the blade, the handle comprising:

a plastic base fixed to the tang and having an externally visible exposed plastic portion, the exposed plastic portion of the plastic base including a handle back extending generally parallel to the tang of the knife along the top of the knife, and a rubber grip fixed to the plastic base and having an externally visible exposed rubber portion, and wherein the rubber grip includes a finger grip portion along the bottom and the two sides of the handle, and a thumb rest portion extending through a part of the plastic handle back at a forward end of the handle back.

2. The knife of claim 1, wherein the handle further comprises:

a hilt extending generally perpendicularly to the elongation direction.

3. The knife of claim 2, wherein the knife further comprises:

a guard fixed to the hilt adjacent to a top of the knife.

4. The knife of claim 3, wherein the guard has a first region fixed to the hilt and a second region remote from the hilt, and wherein the second region is swept forwardly in the direction of the blade.

5. The knife of claim 1, wherein the exposed plastic portion of the plastic base further forms the butt of the knife.

6. The knife of claim 1, wherein the exposed plastic portion of the plastic base further includes a hilt extending generally perpendicularly to the elongation direction and a guard fixed to the hilt adjacent to the top of the knife.

7. A knife, comprising:

a blade that is elongated in an elongation direction;

a tang extending from the blade generally parallel to the elongation direction;

a handle attached to the tang of the blade, the handle comprising:

a plastic base fixed to the tang and having an externally visible exposed plastic portion, and a rubber grip fixed to the plastic base and having an externally visible exposed rubber portion, wherein the handle of the knife has a top, a bottom, two sides, and a butt remote from the blade, and wherein the exposed plastic portion of the plastic base extends generally parallel to the tang of the knife along the top of the knife and forms the butt of the knife and wherein the exposed plastic portion of the plastic base further includes a hilt extending generally perpendicularly to the elongation direction and a guard fixed to the hilt adjacent to the top of the knife, and wherein at least a part of the exposed rubber portion of the rubber grip extends generally parallel to the tang of the knife along the bottom and the two sides of the knife, and wherein the exposed rubber portion of the rubber grip further includes a rubber thumb rest adjacent to the guard.

8. The knife of claim 7, wherein the guard has a first region fixed to the hilt and a second region remote from the hilt, and wherein the second region is swept forwardly in the direction of the blade.

9. The knife of claim 8, wherein the rubber thumb rest is externally visible on the top of the knife in the region of the second region of the guard.

10. The knife of claim 1, wherein the finger grip portion of the rubber grip includes two outwardly protruding raised regions at different distances from the blade of the knife.

* * * * *